United States Patent [19]

Pemberton

[11] Patent Number: 4,669,789

[45] Date of Patent: Jun. 2, 1987

[54] COMPUTER USER'S DESK

[76] Inventor: Peter F. Pemberton, 13 Leslie St., Toowoomba, Queensland, 4350, Australia

[21] Appl. No.: 841,310

[22] Filed: Mar. 19, 1986

[30] Foreign Application Priority Data

Mar. 19, 1985 [AU] Australia ..... PG9804

[51] Int. Cl.[4] ..... A47B 81/06

[52] U.S. Cl. ..... 312/7.2; 312/194; 312/208

[58] Field of Search ..... 312/7.2, 194, 195, 196, 312/21, 22, 208, 231, 233, 270, 201; 358/254

[56] References Cited

U.S. PATENT DOCUMENTS

| | | | |
|---|---|---|---|
| 174,588 | 3/1976 | Stein | 312/201 |
| 427,217 | 5/1890 | Bancroft | 312/21 |
| 1,485,549 | 3/1924 | Bieneman | 312/194 |
| 1,778,877 | 10/1930 | Williams | 312/21 |
| 2,084,197 | 6/1937 | Grosser | 312/233 |
| 2,151,259 | 3/1939 | Young | 312/233 |
| 2,362,877 | 11/1944 | Bargen | 312/231 |
| 3,794,397 | 2/1974 | Flototto | 312/194 |
| 4,145,097 | 3/1979 | Naess et al. | 312/208 |
| 4,296,981 | 10/1981 | Hildebrandt et al. | 312/194 |
| 4,440,457 | 4/1984 | Fogelman et al. | 312/7.2 |

*Primary Examiner*—Victor N. Sakran

*Attorney, Agent, or Firm*—Schwartz, Jeffery, Schwaab, Mack, Blumenthal & Evans

[57] ABSTRACT

A computer desk providing a clear top workspace which is pivotal upwardly with a monitor compartment supported thereunder and brought to a viewing position by lifting the worktop with a computer terminal support being moved thereat to a user accessible position, the computer terminal and monitor being stored out of the way when the worktop is lowered.

4 Claims, 10 Drawing Figures

COMPUTER USER'S DESK

FIELD OF THE INVENTION

This invention relates to improvements in furniture.

The invention is particularly directed to a desk which can accommodate personal or microcomputers and their associated equipment.

BACKGROUND ART

Most students and other personal computer users simply place their computers and associated peripheral devices (e.g. monitors, data cassettes or disk drives, printers, modems, software and documentation) on a desk. This leaves little, if any, area to work on, and the equipment is not secure when not in use.

Security cabinets for personal computers are available (e.g. produced by Sylex Distributors Pty. Ltd. Sydney) but these do not provide secure storage for the monitors and they have little, if any, usable working space when the computer is secured away.

OBJECTS OF THE INVENTION

It is an object of the present invention to provide a desk for computer equipment where the desk has an unobstructed worktop when the computer is not in use.

It is a preferred object to provide a desk where the computer can be raised to a suitable working position when required.

It is a further preferred object to provide a desk where the computer and any peripheral equipment can be securely stored when not in use.

It is a still further preferred object to provide a desk where all wiring can be provided integrally to conceal and protect the cables and connections between the various pieces of equipment.

It is a still further preferred object to protect the computer equipment from dust when not in use.

Other preferred objects of the present invention will become apparent from the following description.

BRIEF OUTLINE OF THE INVENTION

In one aspect the present invention resides in a desk including:

a frame assembly;

a first worktop hinged at one side to the frame assembly; and storage means supported under the worktop; so arranged that in its lowered position, the worktop provides a workspace thereon and equipment is stored in the storage means and in its raised position, access is provided to the equipment stored in the storage means.

Preferably the worktop can be secured and/or locked in its raised and lowered positions.

Preferably the frame assembly includes side panels and a rear panel which enclose the storage means when the worktop is in its lowered position. The side and/or rear panels may extend to the floor or the desk may be supported on legs on a suitable stand.

Preferably the storage means includes one or more compartments e.g. for a computer monitor, data cassette or disk drive, computer disks or diskettes or other suitable equipment and/or software storage.

Preferably the keyboard is supported on a shelf which is preferably advanced towards the user as the worktop is raised. The shelf may have a central horizontal portion hingedly connected to a rear, substantially vertical portion which encloses the lower front portion of the storage means when the worktop is in its lowered position, and a front, substantially vertical portion which engages the forward edge of the worktop to enclose the upper front portion of the storage means.

The shelf may be connected to the storage means on the worktop by levers, linkages, arms with pins in tracks, or other suitable means to advance the shelf as the worktop is raised.

BRIEF DESCRIPTION OF THE DRAWINGS

To enable the invention to be fully understood, a preferred embodiment will now be described with reference to the accompanying drawings, in which.

DESCRIPTION OF PREFERRED EMBODIMENTS

Figure 1:
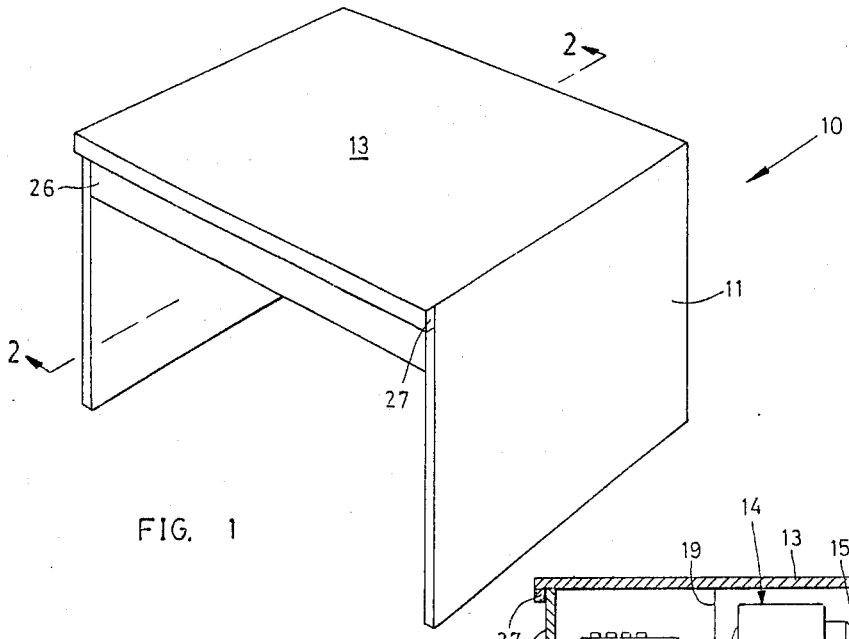
FIG. 1 is a perspective view of the desk with the worktop in the closed position.
Figure 2:
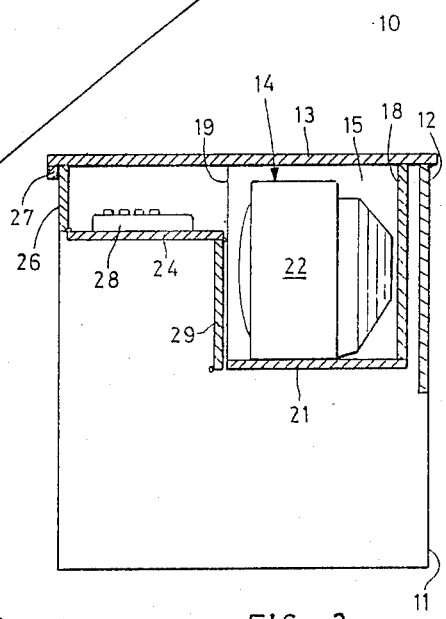
FIG. 2 is a sectional side view taken on line 2—2 on FIG. 1.
Figure 4:
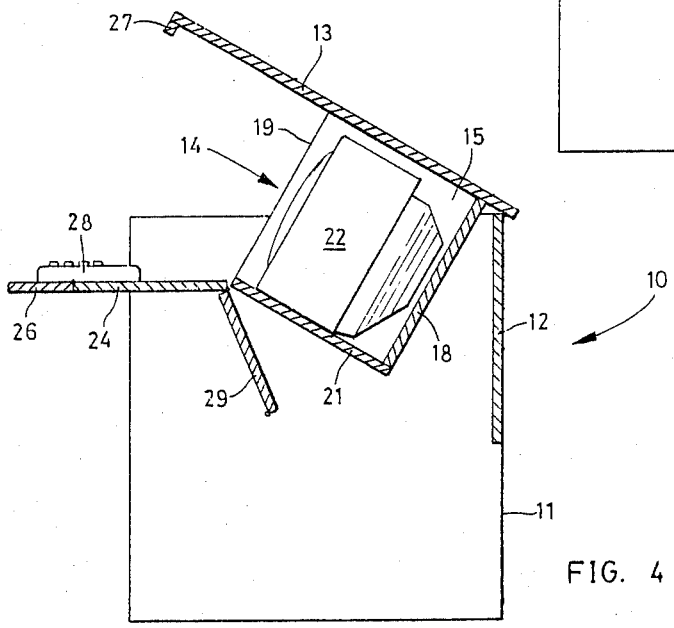
FIG. 4 is a sectional side view taken on line 4—4 on FIG. 3.

Referring now to FIGS. 1 and 2, the desk 10 has a frame with a pair of side panels 11, a rear panel 12 and a worktop 13 hinged to the rear panel 12 along its rear edge.

Storage means 14, comprising a plurality of compartments 15, 16, 17 (see FIG. 3) are provided on the underside of the worktop 13, the compartments being defined by a rear wall 18, side panels 19, dividing wall 20 and floor 21.

Figure 3:
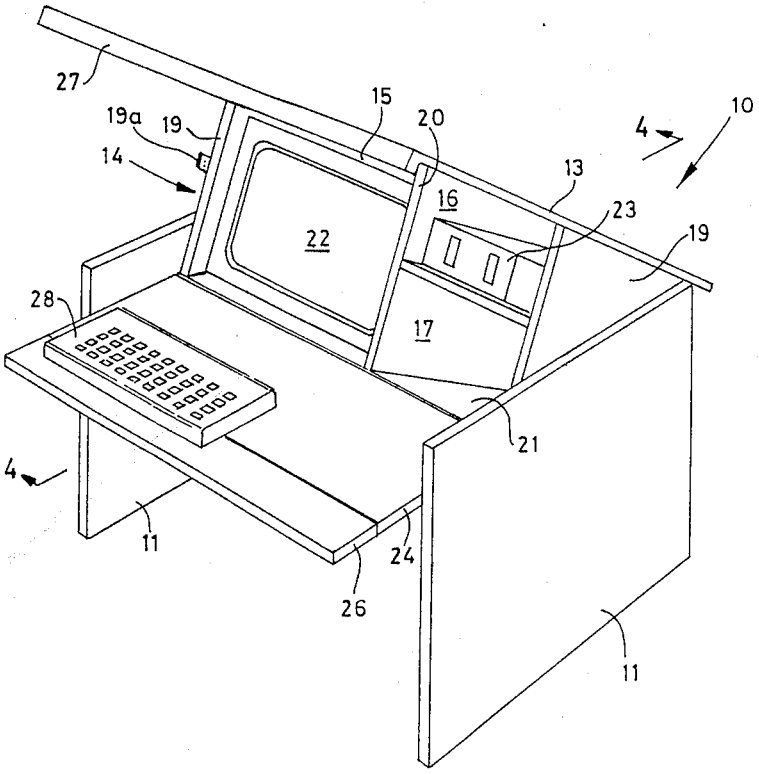
FIG. 3 is a perspective view of the desk with the worktop raised.
Figure 5:
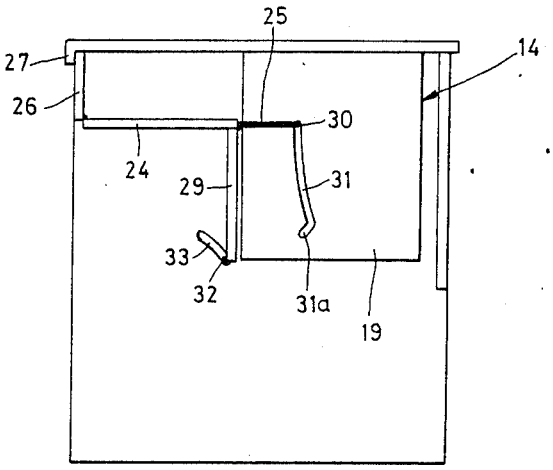
FIG. 5 is a side view of the mechanism for advancing and retracting the keyboard shelf as the worktop is raised or lowered.
Figure 6:
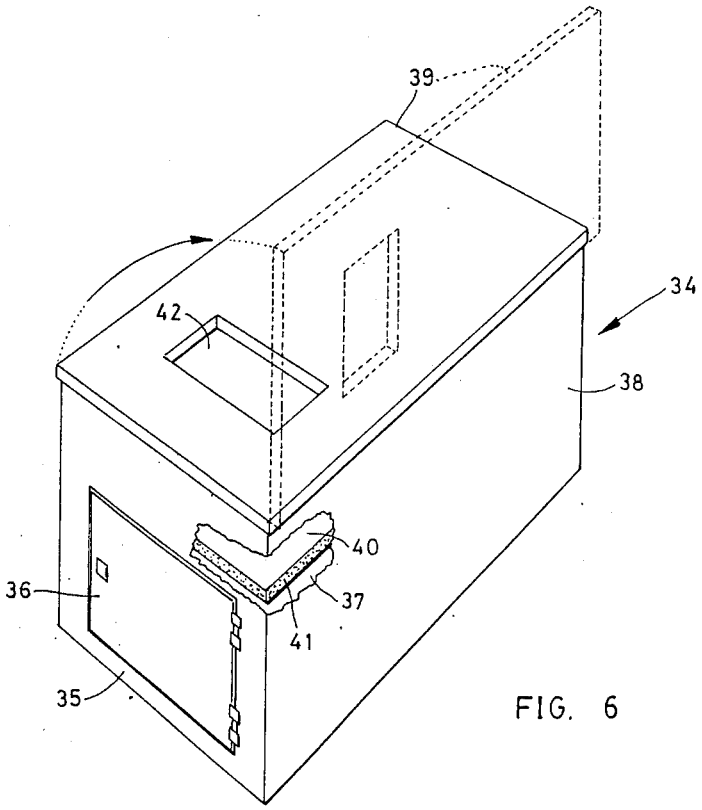
FIG. 6 is a perspective view of a printer cabinet which can be used with the desk, part being shown broken-away and the lid being shown in the raised position in dashed lines.

As shown in FIG. 3, a monitor 22 is provided in the larger compartment 15, a disk drive 23 in upper side compartment 16 and diskette boxes (not shown) in lower side compartment 17.

A shelf 24 is supported on a pair of horizontal arms 25 carried in runners (not shown) on the inner faces of the side panels 11. A front panel 26 is hingedly mounted on the forward edge of the shelf 24.

When the worktop 13 is lowered, the panel 26 is substantially vertical and engaged behind a locking strip 27 provided along the front edge of the worktop, while the panel 26 is lowered to be co-planar with the shelf 24, to support a keyboard 28, when the worktop 13 is raised.

A rear panel 29 is hingedly connected to the rear edge of the shelf 24.

When the worktop is closed, the rear panel 29 is substantially vertical and closes the compartments 15–17, the panel being closely adjacent the forward edges of the walls 19, 20. When the worktop 13 is raised, the shelf 24 is moved forward by pins 30 on the arms 25 which engage curved tracks 31 in the outer faces of the side walls 19 of the storage means. The upper edge of the panel 29 is pulled forward and the lower edge travels in an area defined by pins 32 on the panel 29 which are engaged in tracks 33 in the inner faces of the adjacent side panels 11 of the frame.

When the worktop 13 is in its lowered position (e.g. in FIGS. 1 and 2), a key-operated latch (not shown) may engage the worktop to prevent it being raised and so prevent unauthorized access to the equipment in the storage means 14. (Alternatively, the latch may engage the shelf 24, which engages over lugs 19*a* on the side walls 19 (and dividing wall 20) to prevent the worktop being raised when the shelf is retracted, as shown in FIG. 2).

When the worktop 13 is in its raised position, the pins 30 on the arms 25 may engage in recesses 31*a* in the tracks 31 to secure the worktop in that position.

It will be readily apparent to the skilled addressee that the worktop provides a clear working surface when closed, with full security for the equipment in the storage means 14, while ready access to the equipment is available when the worktop is raised.

A security cabinet 34 may be provided e.g. for a printer (not shown), the cabinet being securely fixed, or releasable from, the desk 10.

The cabinet 34 has a front wall 35 with a lockable door 36 providing access to a lower storage compartment 37, side walls 38, a rear wall (not shown) and a lockable hinged lid 39 providing access to the printer compartment 40 ( which has a floor 41). A window 42 in the lid 39 enables the operator to read the material being printed on the printer, while the hinged lid enables access to the printer (e.g. to remove printed sheets or to supply fresh paper).

To reduce the noise from the printer, the cabinet may be lined with sound absorbent material.

The desk 10 and the cabinet 34 can be provided either fully assembled or completely-knocked-down (CKD) for do-it-yourself (DIY) assembly.

Preferably all electrical wiring and computer cables and connections are provided within the desk and cabinet so that these are not disturbed when the equipment is stored and not in use.

The desk may be mounted on suitable legs or on a stand and alternative mechanisms can be provided to advance and retract the keyboard shelf 24 as the worktop 13 is raised and lowered.

The desk has a pleasing aesthetic appearance and may be manufactured in a wide range of materials and finishes. Because of its configuration it uses very little floor space.

To assist the user to raise and lower the worktop 13, it may be counterbalanced e.g. by a torsion bar, pneumatic or hydraulic struts, a spring-operated linkage or other suitable means.

Figure 7:
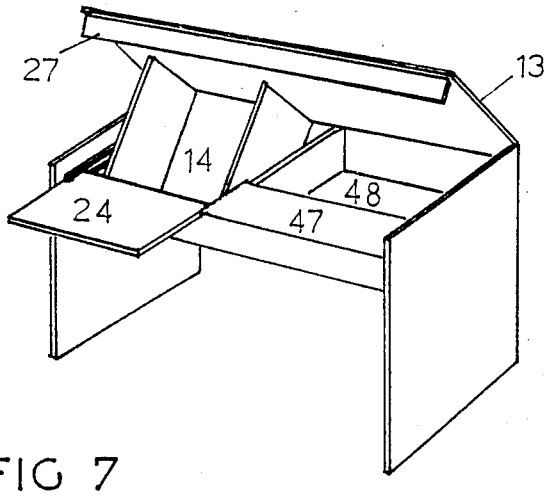
FIG. 7 is a perspective view of an alternate embodiment providing extra storage for peripherals.
Figure 8:
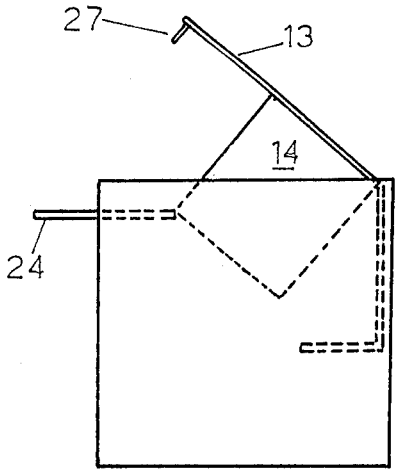
FIG. 8 is a sectional view of the desk of FIG. 7.

In the FIGS. 7 and 8, the desk top 13 is shown raised to move the monitor compartment 14 into a viewing position. The shelf 24 is for the support of a computer terminal, keyboard, PC, etc. as set out above and is slidably movable horizontally between a storage position and a user accessible position in a similar manner to that set out above between edge runners of a suitable form. The desk of this embodiment is elongated to provide additional storage in a compartment 48 with a work surface 47 to accommodate peripheral equipment. This compartment may be suitably sized and soundproofed to accommodate a printer. The desk might be boxed in at this point to provide a tier of drawers for program storage, etc. As in the earlier embodiments, the desk top and monitor may be counter balanced by a torsion bar mechanism or a compensating spring balanced hinge mechanism as are commonly employed with motor vehicle bonnets, etc. In order to secure the top in position, any suitable locking mechanism might be employed. In FIG. 8, it will be seen that the desk components may be dimensioned so that shelf 24 may be moved in under compartment 14 so as to take the desk top weight thereon. As in the earlier embodiments, the monitor compartment may be boxed in so as to provide security from being knocked when in the storage position beneath the desk, with a kick panel being disposed in front of compartment 14.

Figure 9:
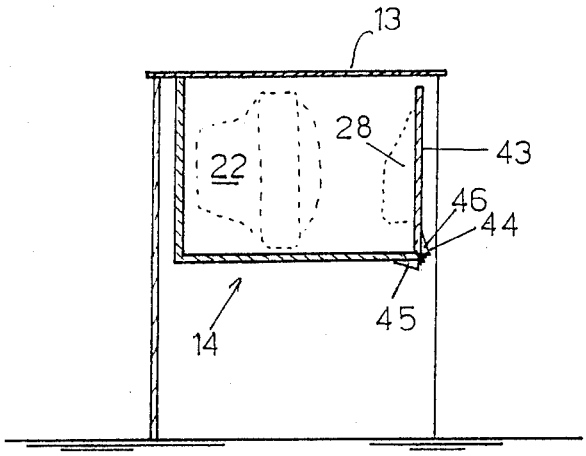
FIGS. 9 and 10 are sectional views of a further embodiment of the invention.
Figure 10:
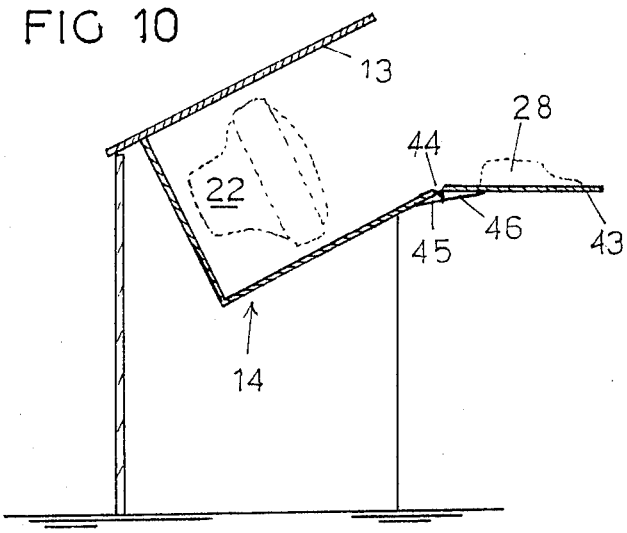

In FIGS. 9 and 10, the monitor 22 is mounted in compartment 13, beneath worktop 13, which is movable pivotally about its rear edge similarly to the other embodiments. The keyboard 28 is mounted upon an angularly displaced support 43 about pivot 44 to be moved to a horizontal situation whereat the monitor may be viewed and the keyboard accessed. When folded up, the top may be lowered so as to be used as a flat work surface. So as to support the keyboard horizontally, the support therefore, shelf 43, may be provided with a suitable stop mechanism such as the abutments 45 and 46 disposed along the back of the hinge so as to limit its angular movement. Alternately, the hinge plates and hinge pin pivot line may be designed so as to limit the plate movement beyond a predetermined angular displacement in the known manner. When folded, the keyboard support becomes a front panel to the desk so as to provide security for the monitor by obscuring it behind the raised shelf 43.

As stated above, the embodiment described is by way of an illustrative example only, and various changes and modifications may be made without departing from the present invention.

I claim:

1. A computer user's desk for containment of a computer terminal and video monitor comprising:

a frame assembly having side panels and a front accommodatable to a seated user;

a first work top hingedly mounted at a rear edge to the frame assembly so as to be pivotally movable about said rear edge between a first horizontal position and a second elevated position, said first work top providing a flat upper work surface when in said first horizontal position;

a monitor storage compartment defined by bottom, back and side walls providing a space for receiving a video monitor, said monitor storage compartment being attached to the undersurface of said first work top and movable therewith, said monitor storage compartment having a front opening extending between forward edges of said side walls so as to expose a video monitor to the view of a user when said first work top is in said second elevated position;

a second work shelf mounted on said frame assembly side panels beneath said first work top and positioned in front of said monitor storage compartment, said second work shelf supported by a pair of horizontal arms slidably mounted on runners attached to inner faces of said side panels and linearly moveable between a first storage position disposed beneath said first work top and a second, accessible position forwardly extended from said desk, said second work shelf being spaced from said first work top when in said first storage position so as to accommodate a computer terminal therebetween; and means for displacing said second work shelf between said first storage position and said second accessible position, said displacing means comprising a first pin and track mechanism, said first pin being attached to said second work shelf horizontal arms which engage said first track being mounted on a side wall of said monitor storage compartment.

2. A computer user's desk as claimed in claim 1, wherein said first pin and track mechanism comprises a generally downwardly curved section defining the forward movement of said second work shelf, and a forwardly cast end portion which receives said first pin, whereby said first work top and said monitor storage compartment are supported by said forwardly cast end portion when in said accessible position.

3. A computer user's desk as claimed in claim 1, wherein a downwardly dependent panel is pivotally connected to said second work shelf and movable therewith, said downwardly dependent panel extending across said monitor storage compartment front opening, said downwardly dependent panel having a second pin which engages a second track mounted on an inner face of said frame assembly side panel.

4. A computer user's desk as claimed in claim 2, wherein a downwardly dependent panel is pivotally connected to said second work shelf and movable therewith, said downwardly dependent panel extending across said monitor storage compartment front opening, said downwardly dependent panel having a second pin which engages a second track mounted on an inner face of said frame assembly side panel.

* * * * *